US006925676B2

(12) United States Patent
Heavner et al.

(10) Patent No.: US 6,925,676 B2
(45) Date of Patent: Aug. 9, 2005

(54) GUTTER CLEANER

(75) Inventors: Bruce G. Heavner, Liberty, MO (US); Earl L. Smith, Liberty, MO (US)

(73) Assignee: Quickie Tool Company, L.L.C., Liberty, MO (US)

( * ) Notice: Subject to any disclaimer, the term of this patent is extended or adjusted under 35 U.S.C. 154(b) by 0 days.

(21) Appl. No.: 10/410,734

(22) Filed: Apr. 10, 2003

(65) Prior Publication Data

US 2003/0213086 A1 Nov. 20, 2003

Related U.S. Application Data

(60) Provisional application No. 60/381,301, filed on May 16, 2002.

(51) Int. Cl.[7] ..... E04D 13/076

(52) U.S. Cl. ..... 15/236.04; 294/19.1

(58) Field of Search ..... 15/105, 236.04; 294/106, 19.1, 22–24, 49, 50.8, 51; 56/333, 334

(56) References Cited

U.S. PATENT DOCUMENTS

| | | | | | |
|---|---|---|---|---|---|
| 285,594 | A | * | 9/1883 | Elliott | 294/49 |
| 2,605,136 | A | | 7/1952 | Kline et al. | |
| 2,910,711 | A | | 11/1959 | Mizelle | |
| 3,601,835 | A | | 8/1971 | Morgan | |
| 4,150,793 | A | | 4/1979 | Russo | |
| 4,310,940 | A | | 1/1982 | Moore | |
| 4,319,851 | A | | 3/1982 | Arthur | |
| 4,349,039 | A | | 9/1982 | Egger | |
| 4,363,335 | A | | 12/1982 | Tapper | |
| 4,750,883 | A | | 6/1988 | Drake | |
| 4,848,818 | A | * | 7/1989 | Smith | 294/19.1 |
| 5,022,586 | A | | 6/1991 | Putnam | |
| 5,037,028 | A | | 8/1991 | Evans | |
| 5,386,942 | A | | 2/1995 | Dietle | |
| 5,390,853 | A | | 2/1995 | Ellul | |
| 5,573,024 | A | | 11/1996 | DeVaney et al. | |
| D392,781 | S | | 3/1998 | McKnight | |
| 5,725,322 | A | | 3/1998 | Evans | |
| 5,727,580 | A | | 3/1998 | Patterson | |
| 5,769,324 | A | | 6/1998 | Lenhart | |
| 5,810,408 | A | * | 9/1998 | Armstrong | 294/57 |
| 5,988,715 | A | | 11/1999 | Mason | |
| 6,209,937 | B1 | * | 4/2001 | Keiter | 294/19.1 |
| 6,315,341 | B1 | * | 11/2001 | Leon et al. | 294/53.5 |
| 6,378,153 | B1 | * | 4/2002 | Morgan | 7/116 |

OTHER PUBLICATIONS

Page 54 from Hard–to–Find Tools Catalog.
Gutter Scoop Hand Tool Catalog p. 8 (1454T Gutter Scoop)
Web site pp. 1–4 for "Working Products, Inc. for Gutter Getter With Wrist Strap"; and "Gutter Grabber".

* cited by examiner

*Primary Examiner*—John Kim
*Assistant Examiner*—Shay L. Balsis
(74) *Attorney, Agent, or Firm*—Hovey Williams LLP

(57) ABSTRACT

The cleaner includes a long pole having a mirror adjacent its upper end for inspection of the gutter from the ground without using a ladder. A gutter-clearing tool above the mirror has a downwardly angled arm provided with a lower working tip that may be in the nature of a scoop. The arm may comprise a two-part construction having an inner work component in the form of a pick for removing downspout clogs and an outer component in the nature of a scoop so that the cleaner can either be used with the scoop or pick as the exposed operating device. Components of the tool can be infinitely adjusted to accommodate gutters of various shapes and sizes and to assure that the user has positioned the device at the most advantageous angle of attack for inspection and cleaning.

22 Claims, 4 Drawing Sheets

GUTTER CLEANER

RELATED APPLICATIONS

This application claims the priority benefit of provisional patent application No. 60/381,301 filed May 16, 2002, said provisional application being hereby incorporated by reference into the present specification.

TECHNICAL FIELD

This invention relates to hand tools for use by homeowners and the like and, more particularly, to a tool that permits the quick and easy cleaning of leaves, sticks and other residue from overhead gutters and downspout openings while the user is safely and securely standing on the ground, instead of leaning precariously at the upper end of a tall ladder.

BACKGROUND AND SUMMARY

Removing leaves, twigs and other residue from overhead gutters on the eaves of homes and other buildings has heretofore been a dangerous and time-consuming job. Homeowners have typically attempted to perform this task by standing on the upper end of a ladder or climbing on the roof and reaching down into the gutter, both of which are obviously quite risky. While the prior art includes a number of efforts to permit the user to clean out the gutters while standing on the ground, such as by using long poles equipped with cumbersome water delivery hoses and other devices, such prior contrivances have suffered from a number of drawbacks which have limited their commercial viability.

The present invention solves the problems and shortcomings of the prior art by providing a gutter cleaner that permits one person to safely, quickly and thoroughly inspect and clean a set of overhead gutters while conveniently standing on the ground out of harms way. In its broadest respects, the present invention includes a standard long pole, which may be telescopic and lockable in an infinite number of extended lengths, a mirror at the upper end of the pole to allow the user to inspect the condition of the gutter before, during and after cleaning operations, and a tool also located at the upper end of the pole for dislodging and removing materials from the inspected gutter. In one preferred form of the invention, the tool is provided with a downardly angled arm that can be inserted down into the gutter above its lip and then pushed or pulled along the length of the gutter, using the pole, so that a work component at the lower tip end of the arm can dislodge and remove the objectionable accumulation of materials. In one preferred embodiment, the work component comprises a scoop having a flat bottom and a squared off leading edge to effectively dislodge and lift the materials from the gutter. The side-to-side angle of the scoop relative to the arm can be adjusted so as to provide the most convenient and effective manipulation by the user, and the angle of incline of the arm plus the rotational position of the scoop about the longitudinal axis of the arm can also be adjusted to provide an infinite number of working positions for the scoop.

The arm can also be flipped over center through an arc of greater than 180° and locked in that position so as to adapt the tool for a scraping or pulling action using the pole, rather than a pushing or scooping action. The mirror may be conveniently adjusted about the axis of the pole into anyone of a number of selected positions to avoid interference between the mirror and the work component at the end of the arm.

Furthermore, in one preferred form, the working arm of the tool comprises a two-part assembly wherein one work component is housed within another and the outer component may be selectively removed to expose the inner component for use. Preferably, the inner component may comprise a pointed device such as a pick having a barb associated with its point, such pick being especially helpful in removing clogs at the opening from the gutter to the downspout. In a most preferred form, the outer component comprises a scoop, the handle of which is hollow so as to receive and contain the pick when the scoop is secured in place for use. Preferably, the major components of the tool can be molded from a suitable synthetic resinous material.

DETAILED DESCRIPTION

The present invention is susceptible of embodiment in many different forms. While the drawings illustrate and the specification describes certain preferred embodiments of the invention, it is to be understood that such disclosure is by way of example only. There is no intent to limit the principles of the present invention to the particular disclosed embodiments.

Figure 1:
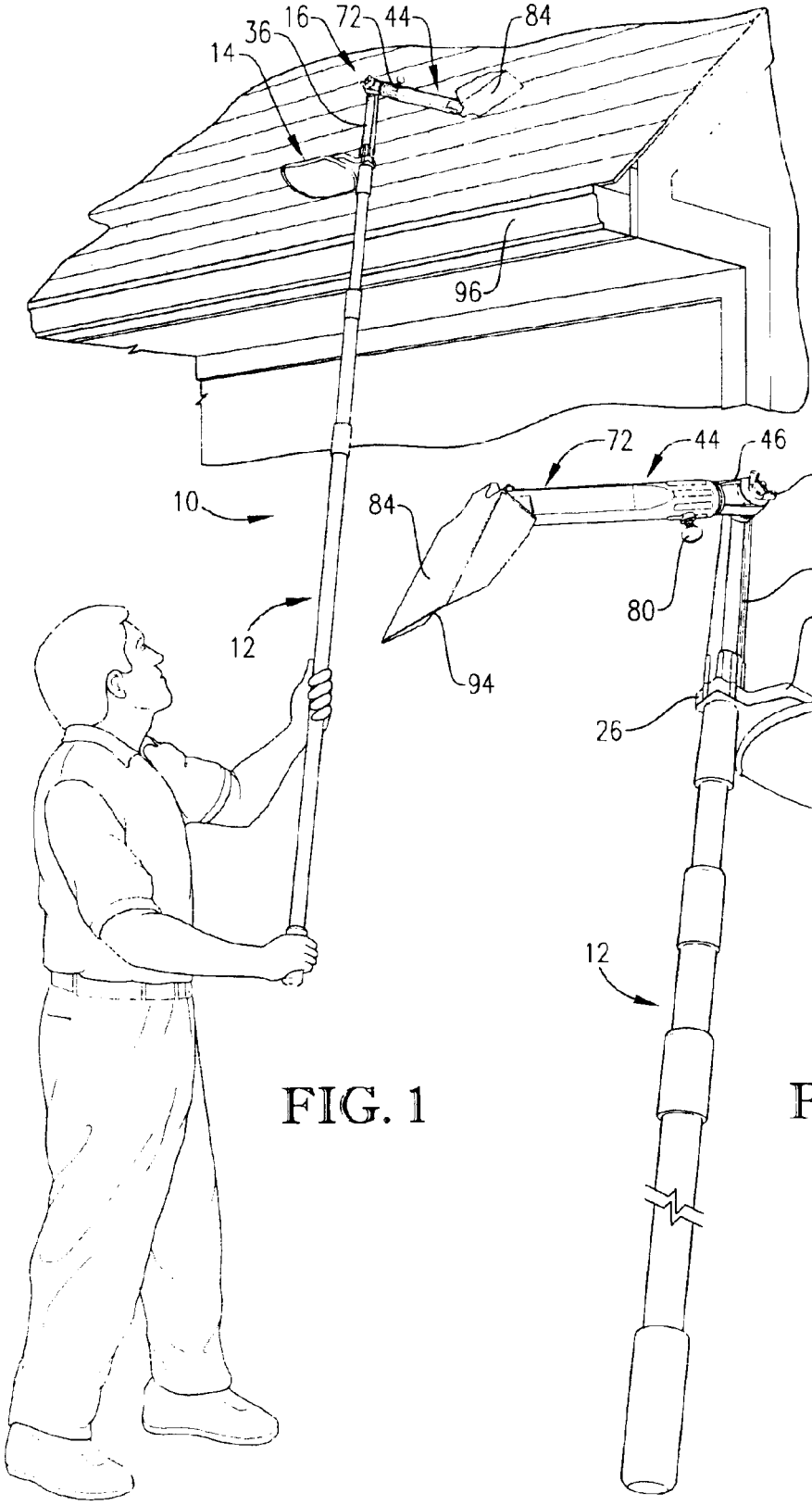
FIG. 1 is a fragmentary perspective illustration of a gutter cleaner constructed in accordance with the principles of the present invention showing one manner of its use.
Figure 2:
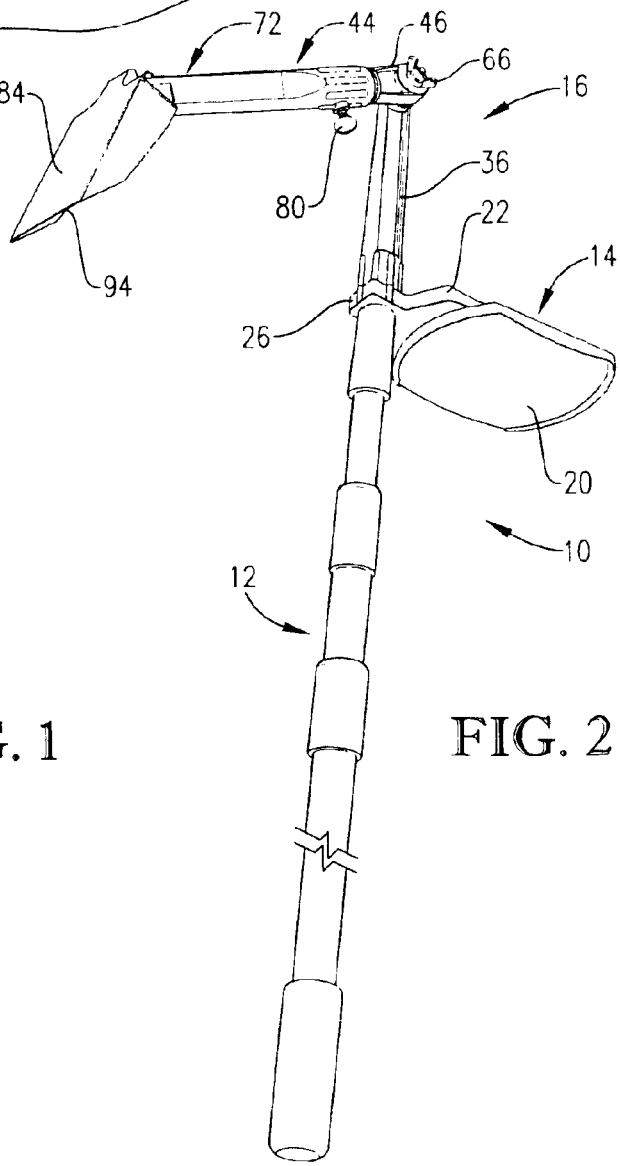
FIG. 2 is an enlarged isometric view of the cleaner.
Figure 3:
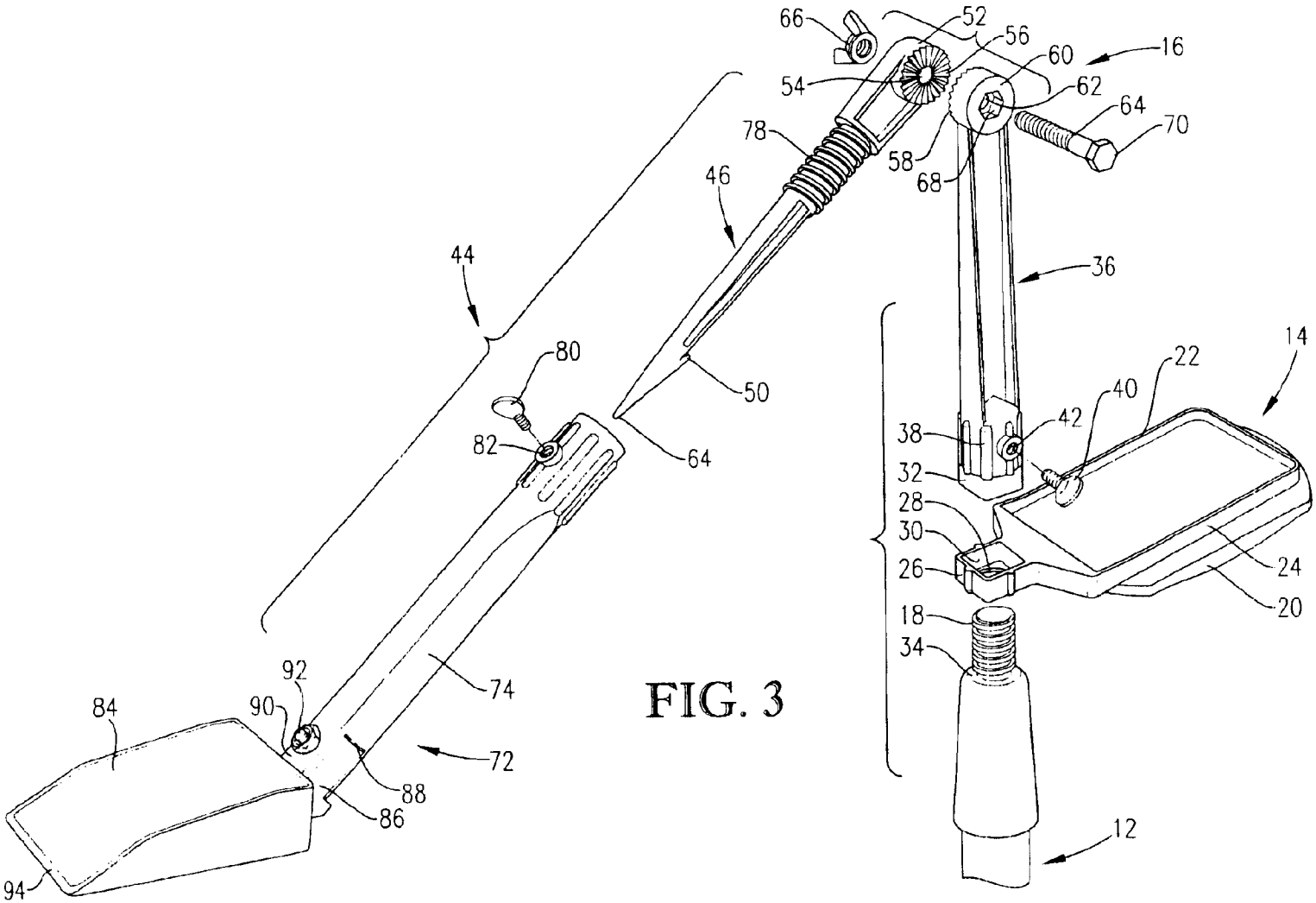
FIG. 3 is a further enlarged exploded illustration of the various parts of the cleaner.

Referring initially to FIGS. 1 and 2, the gutter cleaner 10 broadly comprises three major components, i.e., a pole 12, a mirror 14 adjacent the upper end of pole 12, and a tool 16 secured to the upper end of pole 12 above mirror 14. Pole 12 may comprise any suitable pole available from a wide number of commercial outlets, but preferably takes the form of a standard, four-section, telescoping and locking pole having a threaded uppermost tip 18 as illustrated in FIG. 3. One such suitable pole is available from Bayco Industries of Dallas, Tex., and has three pull-out sections that may be quickly and easily locked in a selected degree of extension by simply rotating the extended portion in a clockwise direction relative to the receiving portion. The pole may be collapsed to a shorter length by simply rotating the extended sections in a counterclockwise direction and telescoping the sections one within the other. Although not illustrated in the drawings, it is to be understood that additional locks could be provided in connection with pole 12 for the purpose of preventing the different extended sections thereof from rotatively unlocking during rigorous use of the cleaner. Such auxiliary locks may take the form, for example, of suitably positioned, aligned holes in the pole sections and cross pins temporarily inserted into such holes.

Mirror 14 preferably comprises a generally rectangular, convex reflector 20 secured to the bottom face of a synthetic resinous, generally plate-like mount 22. Reflector 20 is preferably secured to mount 22 by an adhesive substance, double-sided adhesive tape, or other bonding agent. Mount 22 has upturned ribs or edges 24 to provide rigidity, and is also provided with an outwardly projecting flange 26 at the normally inner end thereof that adapts the mirror assembly 14 for mounting on pole 12.

In this regard, flange 26 has a central, circular hole 28 therethrough (FIG. 3) that is sized to receive and clear the threaded tip 18 of pole 12. Above hole 28 and in open communication therewith, is a rectangular socket 30 that is sized and matingly configured to receive the rectangular lower end 32 of tool 16. Thus, when mirror 14 is assembled onto pole 12 and tip 18 is threaded up into the internally threaded, hollow lower end 32 of tool 16, flange 26 becomes clamped between tool end 32 and a shoulder 34 at the base of threaded tip 18.

Tool 16 includes an elongated extension or base 36 that is preferably molded from synthetic resinous material. The normally bottom end of base 36 comprises the lower end 32 of tool 16 as above described, is hollow and internally threaded, and is provided with a number of external ribs 38 that facilitate screwing base 36 onto threaded tip 18 of pole 12. A setscrew 40 is threadably received by a hole 42 in the sidewall of base 36 slightly above lower end 32 for the purpose of engagement with threaded tip 18 to lock base 36 in place.

At the upper end of base 36, a work arm broadly denoted by the numeral 44 projects angularly therefrom, generally outwardly and downwardly. The outer and downward end of work arm 44 is used to engage, dislodge and remove undesirable materials from a gutter. In the preferred embodiment, work arm 44 comprises a two part assembly of alternatively useable work components, with one such component being stored and housed within the other. When it is not desired to use the inner component, the outer component remains in place, but when the inner component is desired for use, the outer component is removed and set aside.

Figure 6:
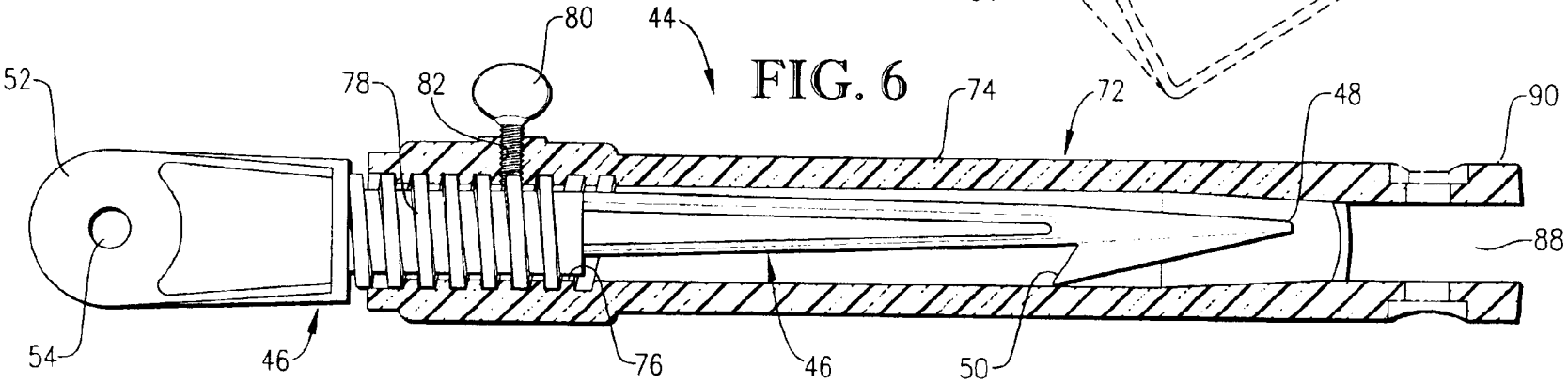
FIG. 6 is a longitudinal cross sectional view of the operating arm illustrating how one work component may be housed and stored within another while the outer component is fully functional.

Preferably the inner component comprises a pointed device in the nature of a pick 46 as shown in FIGS. 3 and 6. Pick 46 is preferably constructed from a synthetic resinous material and has a point 48 at its distal end, along with a barb 50 set back a short distance from point 48. At its opposite end, pick 46 is provided with a generally cylindrical boss 52 having a transverse, circular hole 54 therethrough and a series of generally radially extending teeth 56 on one face of boss 52. Teeth 56 are designed to matingly mesh with a corresponding set of teeth 58 on a generally cylindrical boss 60 at the upper end of base 36. A circular hole 62 through boss 60 is adapted to be aligned with hole 54 in boss 52 for the purpose of receiving a pivot bolt 64 that is provided with a wing nut 66. Thus, when bolt 64 is loosened, pick 46 maybe adjustably rotated about the axis of bolt 64 through an arc substantially greater than 180°. On the other hand, when wing nut 66 is tightened on bolt 64, teeth 56 and 58 may be brought into intermeshing engagement with one another to hold pick 46, and thus arm 44 as a whole, in a selected angular position. Preferably, boss 60 has a countersunk socket 68 including flat internal sidewalls designed to matingly receive corresponding flats on the head 70 of bolt 64 so that bolt 64 does not rotate when head 70 is fully received within socket 68.

A preferred form of the outer work component is a scoop broadly denoted by the numeral 72. Scoop 72 includes a hollow, tubular handle 74 having an internal diameter of such a size that handle 74 readily receives and contains pick 46 as illustrated, for example, in FIG. 6. Internal threads 76 at the upper end of handle 74 are adapted to threadably mesh with external threads 78 adjacent the upper end of pick 46 when handle 74 is slipped on pick 46 and rotated in the appropriate direction. A set screw 80 may be threaded into a hole 82 in the sidewall of handle 74 adjacent its upper end to releasable lock handle 74 against accidental unscrewing from pick 46. Set screw 80 may be loosened and retightened to permit handle 74 to be rotationally adjusted to an infinite positions about the longitudinal axis of pick 46 so as to obtain the most desirable working angle for scoop 72.

Figure 5:
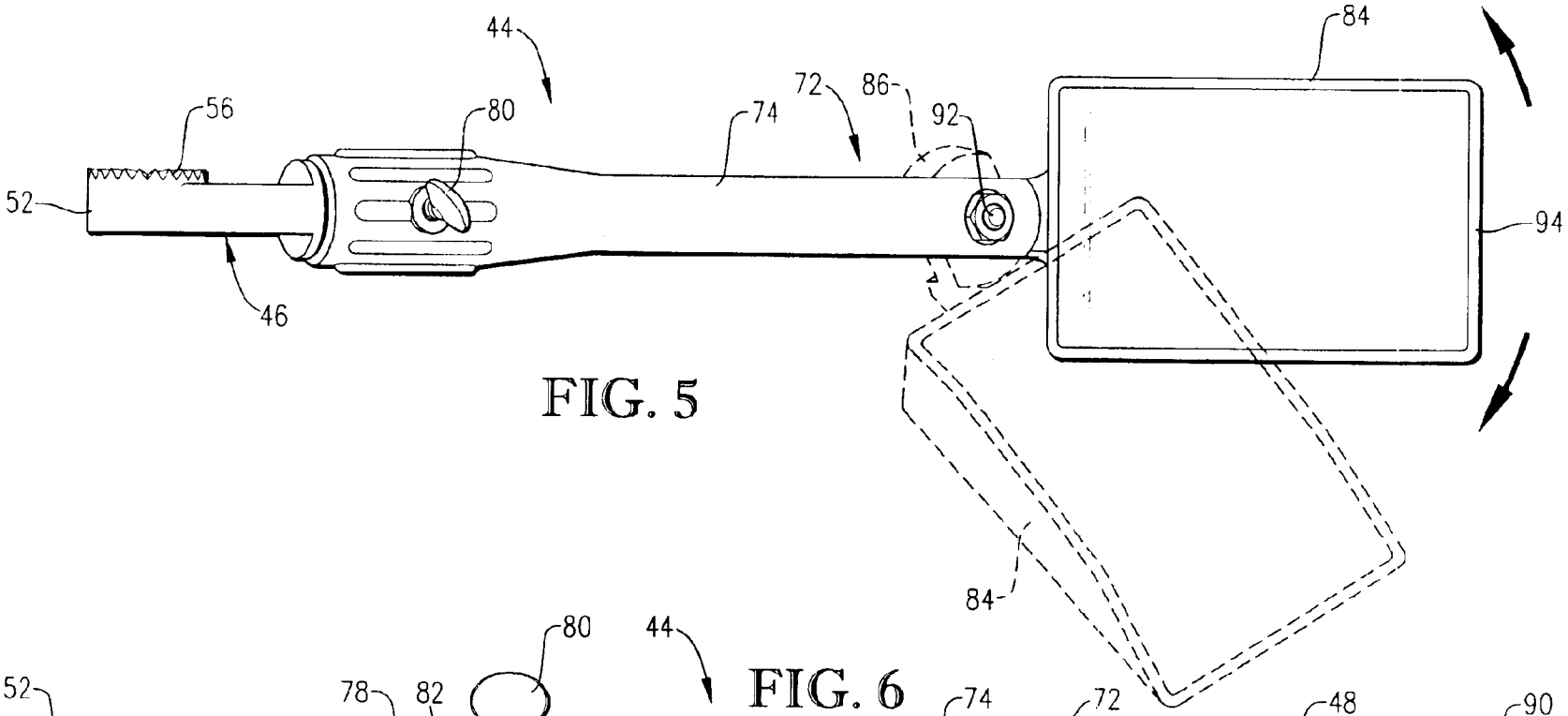
FIG. 5 is a top plan view of the working arm of the tool illustrating how the scoop may be adjusted from side-to-side to change its angle of attack.

Scoop 72 is preferably constructed of synthetic resinous material and further includes a scoop head 84 secured to the normally lower end of handle 74. It will be noted that scoop head 84 juts away from the longitudinal axis of handle 74 at an oblique angle thereto so as to provide an appropriate angle of attack for dislodging and removing debris and other materials in the gutter. A mounting ear 86 projects rearwardly from scoop head 84 and is received within a slot 88 defined by a yoke 90 at the lower end of handle 74. A pivot bolt 92 passes through yoke 90 and ear 86 to secure scoop head 84 on handle 74, but bolt 92 maybe loosened slightly and then retightened for adjusting the side-to-side position of scoop head 84 relative to handle 74 as illustrated in FIG. 5.

It will be appreciated that while work arm 44 has been illustrated herein as a combination pick and scoop assembly, work arm 44 need not necessarily comprise a two-part unit wherein one work device is housed within another. Moreover, the inner device need not necessarily be in the form of a pick, and the outer device need not necessarily be in the form of a scoop or shovel. For example, arm 44 may simply comprise a solid arm with some kind of work component or device at its lower end such as, for example, a scoop head, rake or claw. It has been found, however, that the two-part construction as disclosed herein wherein the inner part is a pick and the outer part is a scoop provides significantly beneficial operating results. Preferably, although not necessarily, scoop head 84 has a straight, squared off front edge 94 to facilitate slipping under debris when the tool is used in a pushing mode as hereinafter explained, and for scraping or ripping the debris when the tool is used more in a pulling mode.

In use, the gutter cleaner 10 is manipulated generally as shown in FIG. 1, wherein pole 12 is extended to the desired length so as to position mirror 14 above and in line with an overhead gutter 96. By observing the image within mirror 14, the user can readily inspect the gutter 96 along its length to determine whether any cleaning is necessary, and can also inspect the opening at the downspout to determine whether any clog exists at that location. If cleaning is necessary, one option is to orient the tool components as shown in FIG. 1 wherein arm 44 is angled downwardly and generally forwardly with respect to the direction of movement along gutter 96, with scoop 94 generally on the front side of pole 12 and mirror 14 generally on the rear side thereof. If necessary, scoop head 94 can be adjustably positioned about pivot bolt 92, and handle 74 can be adjustably rotated about its longitudinal axis to place scoop head 94 at the optimum angle of attack. By then simply pushing the upper end of pole 12 toward the right as viewed in FIG. 1 with scoop head 94 inserted down into gutter 96, leaves and other debris will be dislodged and either spill out over the lip of gutter 96 or can be readily lifted out of the gutter by appropriate manipulation of pole 12. If a mounting nail or other gutter-supporting cross member is encountered, it will be appreciated that the angle of attack of scoop 72 makes it possible to push the materials under the support bolt for a certain distance beyond the bolt and to then lift the scoop 72 out of the gutter and reinsert it on the opposite side of the cross bolt to re-engage the accumulated materials at that point. Mirror 14 provides the constant ability for the user to inspect and monitor the thoroughness of the cleaning process while it is ongoing.

Figure 4:
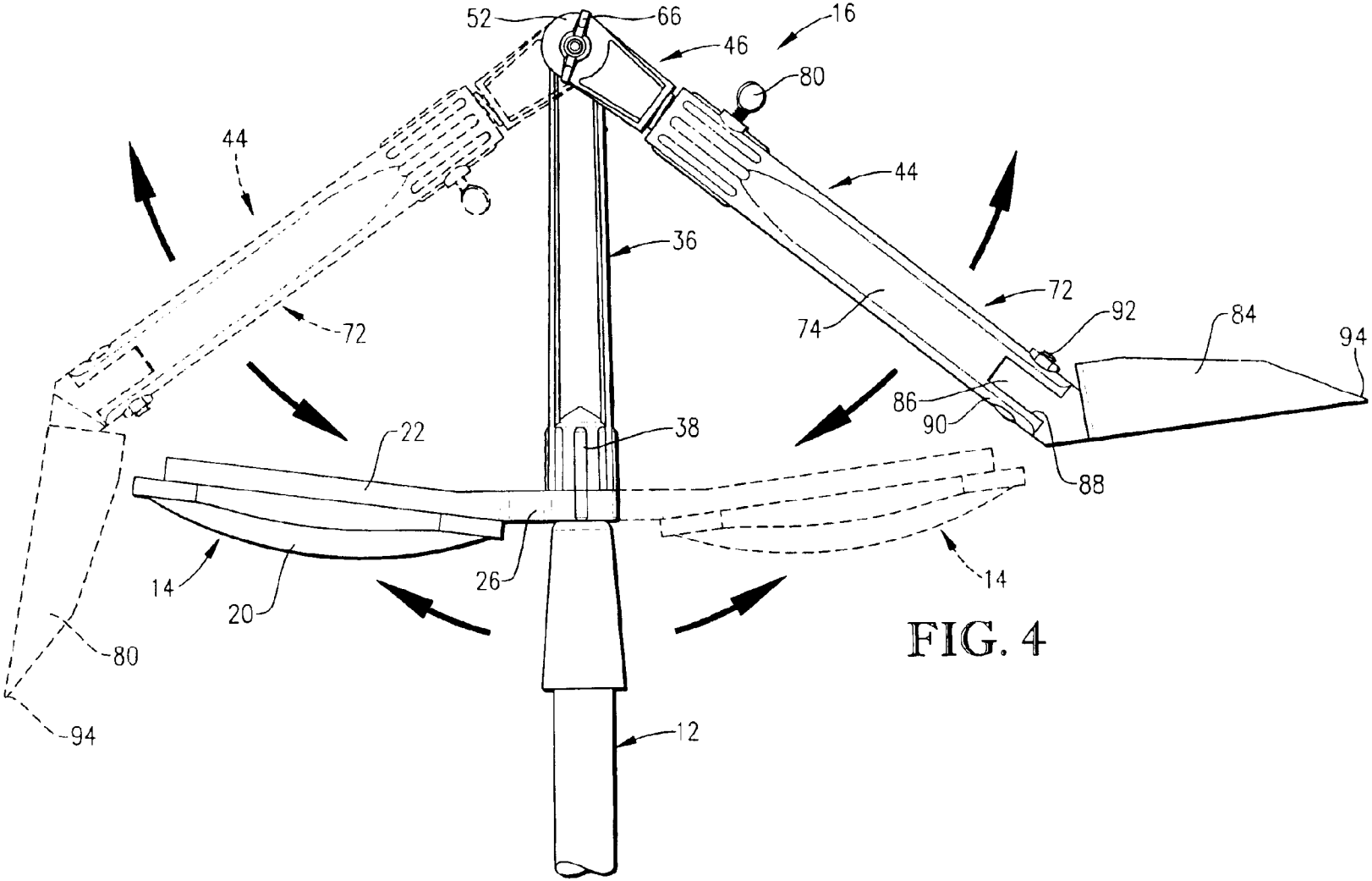
FIG. 4 is a fragmentary elevational view of the cleaner illustrating how the scoop and mirror thereof may be placed in alternative positions for either scooping or scraping materials from the gutter.

In some situations, it has been found desirable-to drag or pull the leading edge 94 of scoop head 84 along the bottom inside surface of gutter 96 in order to dislodge materials. The tool can be quickly and easily prepared for such operation by simply loosening wing nut 66 and flipping arm 44 over-center into a trailing orientation as illustrated in FIG. 2. Mirror 14 may also be repositioned onto the opposite side of pole 12 by unscrewing pole 12 from base 36 a sufficient distance that the rectangular lower end 32 of base 36 is raised relatively out of square socket 30. This permits mirror 14 to be rotated around the threaded tip 18 into the position as illustrated in FIG. 2, whereupon pole 12 can be screwed back into base 36 to re-engage squared end 32 within socket 30 of mirror 14. This adjusted position for pulling and scraping is also illustrated in FIG. 4.

In the event that the opening to a downspout is clogged, or for any other reason, scoop 72 may be easily removed from pick 46 by simply loosening set screw 80 and unscrewing handle 74 from threads 78 on pick 46. Pick 46 can thereafter be used to penetrate and break through clogs with relative ease. Barb 50 can also be used to snag sticks and limbs and other debris for lifting of such materials completely out of the gutter. Replacement of scoop 72 on pick 46 is a simple reversal of the above described process.

The ability to adjust the components of cleaner 10 to an infinite number of positions for obtaining the best operating angles for each particular job is extremely important. By virtue of the setscrew 40 between pole 12 and base 36, the orientation of tool 16 relative to mirror 14 can be quickly and easily changed in 90° increments. By loosening setscrew 40 and then unscrewing pole 12 an adequate distance to withdraw squared end 32 from socket 30 of mirror 14, tool 16 can then be freely rotated by 90° or more. With the squared end 32 aligned with the squared walls of socket 30, the pole 12 may then be screwed back into base 36 to draw squared end 32 down into socket 30. Setscrew 40 is then retightened to hold tool 16 in its new position relative to mirror 14. The angle of arm 44 may also be quickly adjusted by loosening wing nut 66, pivoting arm 44 to the desired position, and then retightening wing nut 66 so that teeth 54 and 58 are re-engaged. And setscrew 80 permits the scoop 72 to be adjustably rotated on pick 46 within a 360° range, while pivot bolt 92 allows the user to select from a wide variety of side-to-side positions for scoop head 84.

It should thus be apparent that the gutter cleaner of the present invention permits one person to quickly, safely and thoroughly clean hard-to-reach, overhead gutters without resorting to dangerous ladders or otherwise taking untoward risks. With the ease and convenience provided by the present invention, the homeowner will be less inclined to ignore this important task, with the result that water damage to home and property from overflowing gutters will be reduced. Moreover, good public health is promoted through the frequent elimination of breeding grounds for mosquitoes and other insects in shallow pools and damp pockets otherwise created by clogged gutters. And the infinitely adjustable working components of the tool assure that virtually all gutters within reach of the pole can be properly cleaned and prepared for their intended use.

The inventor(s) hereby state(s) his/their intent to rely on the Doctrine of Equivalents to determine and assess the reasonably fair scope of his/their invention as pertains to any apparatus not materially departing from but outside the literal scope of the invention as set out in the following claims.

What is claimed is:

1. A gutter cleaner comprising:

a pole having an externally threaded, normally upper end;

a mirror adjacent said normally upper end of the pole for enabling a user grasping a normally lower end of the pole to inspect an overhead gutter by viewing an image of the gutter in the mirror; and a tool including a base secured to the upper end of the pole for removing accumulated residue from the gutter as the pole is manipulated by the user, said base having an internally threaded end threadably receiving the upper end of the pole and being provided with at least one flat external side surface, said mirror having a mounting flange projecting outwardly therefrom, said flange including a socket complementally receiving said end of the base to prevent rotation of the mirror relative to the tool, said flange further being provided with a hole aligned axially with said socket to permit the upper end of the pole to project through the flange and into threaded engagement with the base of the tool, said pole having a shoulder adjacent said upper end thereof, said flange of the mirror being clamped between said shoulder and the base of the tool.

2. A gutter cleaner as claimed in claim 1, said tool comprising a scoop.

3. A gutter cleaner as claimed in claim 1, said tool comprising a pointed component.

4. A gutter cleaner as claimed in claim 3, said pointed component including a barb.

5. A gutter cleaner as claimed in claim 1, said tool comprising a combination pointed component and scoop, said pointed component being housed within a hollow portion of said scoop, said scoop being selectively removable from said pointed component to permit either the scoop or the pointed component to be selected for use.

6. A gutter cleaner as claimed in claim 1, said tool further including an arm having a work component at an end of the arm, said arm being adjustably secured to said base for permitting the working angle of the arm relative to said pole to be adjusted.

7. A gutter cleaner as claimed in claim 6, said base and said arm having mutually interengageable teeth thereon for retaining the arm in a selected angular position when the teeth are interengaged, said base and said arm further being provided with a releasable pivot bolt capable when tightened of releasably holding the teeth in interengaged relationship and when loosened of permitting the arm to be adjustably pivoted about the axis of the bolt between multiple angularly adjusted positions.

8. A gutter cleaner as claimed in claim 6, said arm being adjustable through an arc of more than 180° to permit the work component to be alternatively positioned for pushing through the gutter ahead of the pole or pulling through the gutter behind the pole.

9. A gutter cleaner as claimed in claim 8, said mirror projecting laterally outwardly from the pole and being adjustably positionable about the longitudinal axis of the pole.

10. A gutter cleaner as claimed in claim 6, said work component comprising a scoop.

11. A gutter cleaner as claimed in claim 10, said arm having a longitudinal axis, said scoop projecting laterally outwardly away from said longitudinal axis at an oblique angle thereto, said arm being adjustably rotatable about said axis.

12. A gutter cleaner as claimed in claim 10, said arm having a longitudinal axis, said scoop being mounted on said arm for lateral angular adjustment relative to said longitudinal axis of the arm.

13. A gutter cleaner as claimed in claim 1, said tool comprising a pair of work components housed one within the other, said other component being selectively removable from said one component to permit either the one component or the other component to be selected for use.

14. A gutter cleaner as claimed in claim 13, said other component being threadably secured to the one component.

15. A gutter cleaner as claimed in claim 13, said one component comprising a pick.

16. A gutter cleaner as claimed in claim 13, said other component comprising a scoop.

17. A gutter cleaner as claimed in claim 16, said one component comprising a pick.

18. A gutter cleaning attachment for the externally threaded end of a pole comprising:

a gutter cleaning tool including a base adapted to be secured to the pole, said base having an internally threaded end for receiving the externally threaded end of the pole and being provided with at least one flat external side surface; and a mirror attachable to said tool and having a mounting flange projecting outwardly therefrom, said flange including a socket configured for complementally receiving said end of the base to prevent rotation of the mirror relative to the tool when the mirror is attached thereto, said flange further being provided with a hole aligned axially with said socket to permit the threaded end of the pole to project through the flange and into threaded engagement with the base of the tool when the tool and the mirror are attached to the pole.

19. A gutter cleaning attachment as claimed in claim 18, said tool including a first work component angularly mounted on said base; and a second work component mounted on and enclosing said first component, said second work component being selectively removable from said first component.

20. A gutter cleaning attachment as claimed in claim 19, said first work component being pointed.

21. A gutter cleaning attachment as claimed in claim 19, said second work component comprising a scoop.

22. A gutter cleaning attachment as claimed in claim 21, said first work component being pointed.

* * * * *